US005584547A

United States Patent [19]

Trulaske, Sr.

[11] Patent Number: 5,584,547

[45] Date of Patent: Dec. 17, 1996

[54] CURVED PANEL CONSTRUCTION FOR A MERCHANDISER

[75] Inventor: Steven L. Trulaske, Sr., Ladue, Mo.

[73] Assignee: True Manufacturing Co., Inc., O'Fallon, Mo.

[21] Appl. No.: 324,230

[22] Filed: Oct. 17, 1994

[51] Int. Cl.[6] ..... A47B 97/00

[52] U.S. Cl. ..... 312/223.5; 312/204; 312/114; 312/116; 312/401; 312/406.2; 40/575; 362/223; 362/260; D20/1; D20/4; D20/5

[58] Field of Search ..... 312/223.5, 204, 312/114, 116; 40/575; 362/806, 29, 223, 320, 260; D20/1, 4, 5; 221/24, 92

[56] References Cited

U.S. PATENT DOCUMENTS

| | | | |
|---|---|---|---|
| D. 108,559 | 2/1938 | Boyce . | |
| D. 121,761 | 8/1940 | Clerc . | |
| D. 141,097 | 5/1945 | Pinanski . | |
| D. 148,212 | 12/1947 | Boyce . | |
| D. 178,570 | 8/1956 | Hyde . | |
| D. 244,019 | 4/1977 | Brown . | |
| D. 265,316 | 7/1982 | Trulaske . | |
| D. 271,877 | 12/1983 | Hoff . | |
| D. 275,019 | 8/1984 | Morgan, Jr. et al. | D20/5 |
| D. 285,577 | 9/1986 | Bristow et al. | D20/4 |
| D. 290,012 | 5/1987 | Owen . | |
| D. 290,619 | 6/1987 | Brandes et al. . | |
| D. 292,993 | 12/1987 | Morgan, Jr. et al. | D20/4 X |
| D. 294,716 | 3/1988 | Morgan, Jr. | D20/1 X |
| D. 294,717 | 3/1988 | Morgan, Jr. . | |
| D. 294,718 | 3/1988 | Morgan, Jr. | D20/5 |
| D. 294,719 | 3/1988 | Morgan, Jr. | D20/1 X |
| D. 297,740 | 9/1988 | Morgan, Jr. . | |
| D. 297,741 | 9/1988 | Morgan, Jr. . | |
| D. 297,742 | 9/1988 | Morgan, Jr. . | |
| D. 299,725 | 2/1989 | Brandes et al. . | |
| D. 300,153 | 3/1989 | Morgan, Jr. . | |
| D. 300,595 | 4/1989 | Boxall . | |
| D. 306,092 | 2/1990 | Rockola | D20/5 |
| D. 314,795 | 2/1991 | McGarrah | D20/5 |
| D. 315,747 | 3/1991 | Golley et al. . | |
| D. 318,071 | 7/1991 | Sullivan . | |
| D. 320,233 | 9/1991 | Golley et al. . | |
| D. 331,847 | 12/1992 | Allen . | |
| D. 342,744 | 12/1993 | Renner . | |
| D. 348,160 | 6/1994 | Bustos . | |
| D. 350,245 | 9/1994 | Branz et al. | D6/472 |
| D. 363,398 | 10/1995 | Branz et al. | D6/472 |
| 2,623,160 | 12/1952 | McPhail | 362/223 |
| 4,246,629 | 1/1981 | Marrero | 362/260 X |
| 4,323,955 | 4/1982 | Mark | 362/223 X |
| 4,464,707 | 8/1984 | Forrest | 362/223 X |
| 4,876,633 | 10/1989 | Engel | 362/223 X |
| 4,977,754 | 12/1990 | Upton et al. . | |
| 5,255,968 | 10/1993 | Craven | 40/575 X |
| 5,373,428 | 12/1994 | Day | 362/223 X |
| 5,509,225 | 4/1996 | Minh et al. | 40/575 X |

*Primary Examiner*—Peter M. Cuomo
*Assistant Examiner*—Rodney B. White
*Attorney, Agent, or Firm*—Cohn, Powell & Hind, P.C.

[57] ABSTRACT

This panel assembly (30) for a merchandiser (10) includes frame assembly (34) includes attached to the merchandiser and wall (22) and an aracuate translucent sheet (34). The frame assembly (34) includes opposed side retaining rails (36) receiving the flexed arcuate sheet (34) in retained relation, a lower base member (46) having an arcuate front wall (52), and an upper cap member (56) having an arcuate front wall (62). The panel assembly (30) includes a back-lighting assembly (80) for illuminating the translucent sheet (34).

15 Claims, 2 Drawing Sheets

CURVED PANEL CONSTRUCTION FOR A MERCHANDISER

BACKGROUND OF THE INVENTION

This invention relates generally to refrigerated coolers of the type known as glass door merchandisers and particularly to a merchandiser having a curved end panel construction.

Merchandisers of the type under consideration are usually found in supermarket express lane checkout aisles, hotel lobby stores, health clubs and similar locations. In addition to being convenient and accessible and providing maximum interior storage space it is important that they be eye-appealing to the customer in exterior appearance. Since the utilitarian requirements and cost effectiveness are important considerations, merchandisers tend to be rectangular blocks, having an essentially flat glass door at the front and sometimes at the rear, flat ends and a flat top. The flat end appearance is a reflection of the interior space and it is desirable in some instances to provide an alternative which is attractive yet preserves the utilitarian aspects of the interior space. Vending machines are known such as U.S. Pat. No. D294,716 which have rounded front panels and U.S. Pat. Nos. D294,718 and D318,071 which have combined rounded front panels and side panels. Vending cabinets and beverage dispensers, such as U.S. Pat. Nos. D121,761 and D300,595, respectively, are also known which have rounded ends but these ends are virtually semi-circular and, structurally, the exterior appearance reflects the interior space.

The present invention utilizes a panel construction which permits the provision of rounded ends on a merchandiser in a manner not revealed in the known prior art.

SUMMARY OF THE INVENTION

This invention provides a refrigerated merchandiser having rounded end panel construction without altering the interior capacity or arrangement of the unit. The panel construction can also be used to convert a conventional flat ended merchandiser into one having curved ends.

This invention provides a merchandiser having a generally rectangular wall, opposed elongate side members and attachment means operatively attaching the side members to the wall, a lower transverse member having an arcuate front portion and attachment means for operatively attaching the lower member to the wall, an upper transverse member having an arcuate front portion and attachment means operatively attaching the upper member to the wall, an arcuate sheet of translucent material having upper and lower margins and opposed side margins, and the side members cooperating to provide means for operatively retaining the arcuate sheet on said wall.

It is an aspect of this invention to provide that the lower member is a pan-shaped member having a generally arcuate front wall, and another aspect to provide that the upper member is a pan-shaped member having a generally arcuate front wall.

It is still another aspect of this invention to provide that the upper member attachment means includes a generally horizontal member, disposed in spaced parallel relation to the upper member and connected to the merchandiser wall, and spacer means between the upper member and said horizontal member.

It is yet another aspect of this invention to provide that the elongate side members are inwardly turned and angle-shaped, the angle between members substantially corresponding to the end angle between the curved sheet and the merchandiser wall, the elongate side members providing retaining means and framing means for the arcuate sheet.

It is an aspect of this invention to provide that the upper and lower pan-shaped members, are reversely formed relative to each other, to provide framing means for the arcuate sheet.

It is another aspect of this invention to provide that the side members stop short of the pan-shaped members.

It is still another aspect of this invention to provide that said arcuate sheet and the wall cooperate to define a generally segmental space, and lighting means is provided within the segmental space to back-light the arcuate sheet, and another aspect to provide that the back-lighting means includes a plurality of fluorescent tubes.

It is an aspect of this invention to provide a merchandiser comprising a front wall, a rear wall and opposed generally rectangular end walls, frame means carried by each end wall, each frame means including a pair of opposed elongate, generally vertical side retaining members formed from angularly related legs, one of the legs being attached to said end wall and the other of the legs being angled toward the corresponding leg of the other retaining member, and an initially flat sheet of translucent plastic having upper and lower margins and opposed side margins, at least the side margins being retained in overlapped arcuate configuration by at least the frame side members.

It is another aspect of this invention to provide that each frame means includes a lower, pan-shaped base member having a panel portion and an arcuate wall portion, the arcuate wall portion overlapping the arcuate sheet lower margin in the installed condition, and another aspect to provide that each frame means includes an upper, pan-shaped cap member having a panel portion and an arcuate wall portion, the arcuate wall portion overlapping said arcuate sheet upper margin.

It is still another aspect of this invention to provide that at least one of the front walls and rear walls is a glass access door.

It is yet another aspect of this invention to provide a method of forming a curved end on a merchandiser having a generally rectangular flat end wall, comprising the steps of attaching spaced elongate retainer members having outstanding, inwardly angled legs, to each side of the end wall, providing a generally rectangular flat sheet having side, lower and upper margins and having a width greater than the minimum transverse distance between the inwardly angled legs, attaching an elongate base member to the lower end of the wall, flexing the sheet so that it can be inserted in retained relation between overlapping inwardly angled legs, and attaching an upper elongate cap member to the upper end of the wall.

It is an aspect of this invention to provide a merchandiser with a rounded end panel construction, which is relatively simple and inexpensive to manufacture and effective for its intended purpose.

Figure 1:
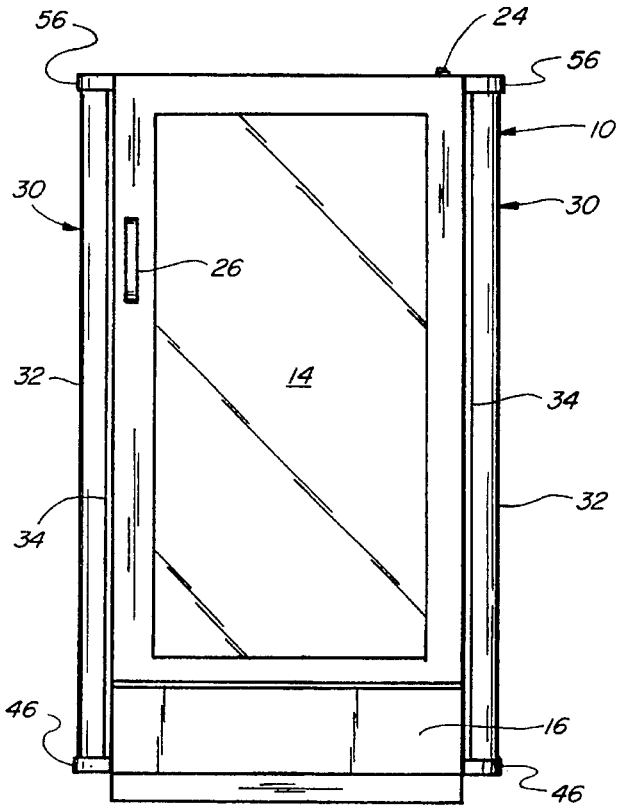
FIG. 1 is a front elevational view of the merchandiser.
Figure 3:
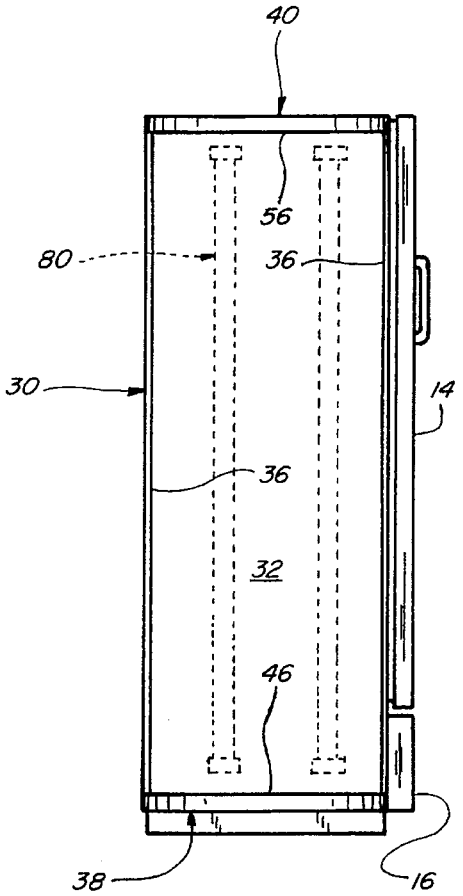
FIG. 3 is an end view thereof.
Figure 2:
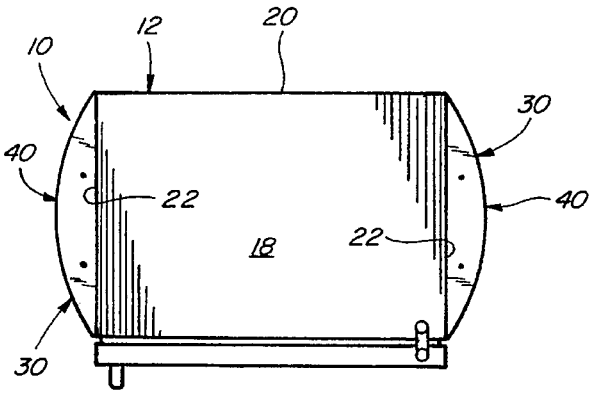
FIG. 2 is a plan view thereof.

DESCRIPTION OF THE PREFERRED EMBODIMENT:

Referring now by reference numerals to the drawings and first to FIGS. 1–4, it will be understood that the refrigerated cooler or merchandiser 10 includes a body 12 having a glass front access door 14, bottom portion 16, an upper wall 18, a rear wall 20 and end walls 22. Curved end panels 30 are attached to each of the generally rectangular flat end walls 22. In the embodiment shown, the access door 14 is provided with a hinge 24 at the right hand end and is opened outwardly by means of a handle 26.

The end walls 22 are substantially identical and the curved end panel assembly 30 will described with reference to the left hand end panel assembly, it being understood that the right hand panel assembly is substantially identical.

The curved end panel assembly 30 includes an arcuate sheet 32 of translucent plastic material, such as Lexan, and a frame, generally indicated by numeral 34, by which the sheet 32 is held in place. The frame 34, in the embodiment shown, includes opposed elongate members providing retaining rails 36, lower transverse base assembly 38 and an upper cap assembly 40.

Figure 6:
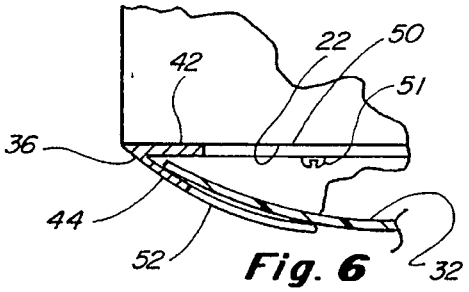
FIG. 6 is a fragmentary cross-sectional view taken on line 6—6 of FIG. 4.

The retaining rails 36 extend substantially the entire height of the end wall 22 and, in the embodiment shown, the rails are angle-shaped having a first leg 42 attached to the end wall 22, as by fasteners 43, and a second, narrower outstanding leg 44. The outstanding legs 44 are directed inwardly and act to retain the sheet 32, which is initially flat having side margins 33, lower margin 35 and upper margin 37. The sheet 32, in the embodiment shown, is flexed so that it is bent into a curve and can be slid into retained relation within the overlapping rails 36 without the need for fasteners. As shown in FIG. 6, the angle of the retaining rail outstanding leg 44 preferably conforms substantially to the angle of the flexed sheet. In the embodiment shown, the unflexed width of the arcuate sheet between the side margins is slightly greater than the flexed width and the sheet is held in place by its own resilience.

The transverse base assembly 38 includes a pan member 46 having a lower wall 48, a rear straight wall 50 attached to the merchandiser end wall 22, as by threaded fasteners 51, and an arcuate front wall 52 conforming to the induced curve of the translucent sheet lower margin 35. In the preferred embodiment, the retaining rails 36 extend downwardly substantially to, but not into, the pan member 46. The arcuate sheet lower margin 35 is received within and overlapped by the pan member arcuate front wall 52.

Figure 5:
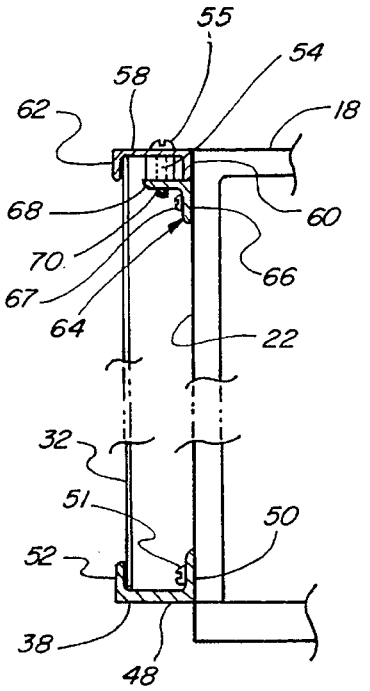
FIG. 5 is a fragmentary cross-sectional view taken on line 5—5 of FIG. 4.

The transverse cap assembly 40 includes an inverted pan member 56 having an upper wall 58, a straight wall 60 and an arcuate front wall 62 conforming to the induced curve of the translucent sheet upper margin 37. In the embodiment shown, the cap assembly 40 includes a pair of spacer blocks 54 attached to the upper wall 58 as by adhesive and said upper wall and associated spacer blocks are apertured to receive threaded fasteners 55. As shown in FIG. 5, a horizontal seating member 64 is provided having a vertical leg 66 attached to the end wall 22, as by threaded fasteners 67, and an outstanding leg 68. The outstanding leg 68 includes a pair of threaded openings 70, which receive adjustable threaded fasteners 55 passing through the spacer blocks 54. In the preferred embodiment, the retaining rails 36 extend upwardly to, but not into, the pan member 56. The translucent arcuate sheet upper margin 37 is received within and overlapped by the inverted pan member arcuate front wall 62.

This arrangement of overlapping side rails 36 and upper and lower pan members 46 and 56 respectively provides a neat framed appearance to the arcuate sheet 32 without unsightly gaps.

A back-lighting assembly 80 is provided within the arcuate, generally segmental, elongate space defined by the arcuate sheet 32 and the merchandiser end wall 22. In the embodiment shown, the back lighting is provided by two fluorescent tubes 82 extending substantially between the upper seating member 64 and lower pan member 46 and attached as by brackets 84. A ballast unit 86 is provided between the tubes 82.

Figure 4:
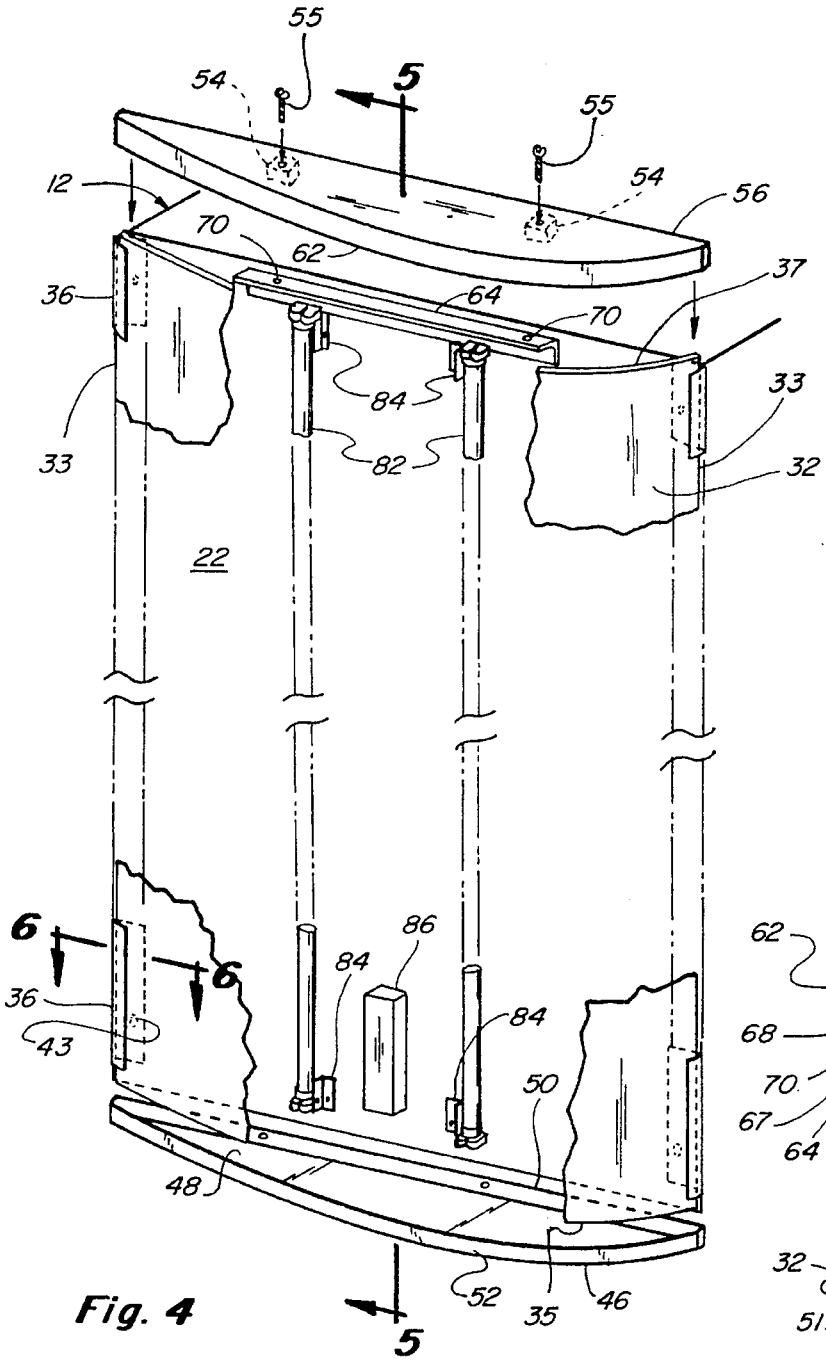
FIG. 4 is an exploded perspective view of the end panel construction.

It is thought that the structural features and functional advantages of this curved end panel assembly 30 have become fully apparent from the foregoing description of parts but for completeness of disclosure the installation of the assembly will be briefly described with reference to FIGS. 4–6.

Preferably, the lighting assembly 80 is first installed on the end wall 22 followed by the horizontal seating member 64. The side retainer rails 36 and base pan member 46 are then attached to the end wall 22. This permits the translucent sheet 32 to be bent into a suitable curve and slid into place within the rails 36 and the pan member 46. Finally, the inverted pan member 56 is placed over the sheet 32 and adjusted to suit the proper height. When this is done the side rails 36 base pan member 46 and cap pan member 56 provide a substantially continuous overlapping margin for the translucent sheet. In the embodiment shown, the lower and upper pan members 46 and 56 respectively are provided by identical plastic moldings. Further, while curved panel assembly 30 has been shown attached to a merchandiser end wall it will be understood that it could be used for other walls.

Although the invention has been described by making detailed reference to the preferred embodiments, such detail is to be understood in an instructive rather than in any restrictive sense, many other variants being possible within the scope of the claims hereunto appended.

I claim as my invention:

1. A curved panel construction for a merchandiser comprising:

(a) a merchandiser having a generally rectangular flat end wall, (b) opposed elongate side members and attachment means operatively attaching the side members to the wall, (c) a lower transverse member having an arcuate front portion, a rear portion and attachment means for operatively attaching the lower member rear portion to the wall, (d) an upper transverse member having an arcuate front portion, a rear portion and attachment means operatively attaching the upper member rear portion to the wall, and (e) an arcuate sheet of material having upper and lower margins and opposed side margins, (f) said side members cooperating to provide means for operatively retaining said arcuate sheet on said wall, (g) at least one of said upper and lower members being a pan-shaped member having an arcuate front wall and a straight rear wall, said front wall conforming generally to the arcuate sheet of material and said rear wall conforming generally to the flat end wall.

2. A curved panel construction as defined in claim 1, in which:

(h) said upper and lower members are pan-shaped members.

3. A curved panel construction as defined in claim 1, in which:

(h) said elongate side members are inwardly turned and generally V-shaped including an acute angle, said side members being operatively attached to the flat end wall the angle between said V-shaped members substantially corresponding to an end angle between the arcuate sheet and said wall.

4. A curved panel construction as defined in claim 1, in which:

(h) said upper and lower members are pan-shaped members, reversely formed relative to each other, to provide framing means for the said arcuate sheet.

5. A curved panel construction as defined in claim 4, in which:

(i) said side members stop short of said pan-shaped members.

6. A curved panel construction as defined in claim 1, in which:

(h) said arcuate sheet and said wall cooperate to define a generally segmental space, and (i) lighting means is provided within the segmental space to back-light the arcuate sheet.

7. A curved panel construction for a merchandiser comprising:

(a) a merchandiser having a generally rectangular wall, (b) opposed elongate side members and attachment means operatively attaching the side members to the wall, (c) a lower transverse member having an arcuate front portion and attachment means for operatively attaching the lower member to the wall, (d) an upper transverse member having an arcuate front portion and attachment means operatively attaching the upper member to the wall, (e) an arcuate sheet of translucent material having upper and lower margins and opposed side margins, and (f) said side members cooperating to provide means for operatively retaining said arcuate sheet on said wall, (g) said upper member attachment means including a generally horizontal member, disposed in spaced parallel relation to said upper member and connected to said merchandiser wall, and spacer means between said upper member and said horizontal member.

8. A merchandiser comprising:

(a) a front wall, a rear wall and opposed generally rectangular flat end walls having oppposed side edges, (b) frame means carried by each end wall, each frame means including a pair of opposed elongate, generally vertical side retaining members each formed from two angularly related legs, one of said legs being attached to said end wall adjacent an associated side edge and the other of said legs being outstanding and angled inwardly toward a corresponding leg of the other retaining member, and each frame means including a lower member and an upper member each having an arcuate front wall portion and a rear wall portion attached to said end wall and (c) an initially flat sheet of material having upper and lower margins and opposed side margins, said side margins being retained in overlapped arcuate configuration by at least said frame side members and said lower and upper margins being overlapped by said arcuate front wall portions of said lower member and said upper member, respectively.

9. A merchandiser as defined in claim 8, in which:

(d) each frame means includes a lower, pan-shaped base member and an upper pan-shaped cap member, each of said members having a panel portion and an arcuate wall portion and a rear wall portion.

10. A merchandiser as defined in claim 8, in which:

(d) said front wall is a generally flat glass access door.

11. A merchandiser as defined in claim 8, in which:

(d) said initially flat sheet of material is translucent and is bowed into an arc to define a segment with said end wall and lighting means is housed in said segment to back light said translucent sheet.

12. A method of forming a curved end on a merchandiser having a generally rectangular flat end wall of substantially constant height and substantially constant width and opposed vertical side edges, comprising the steps of:

(a) attaching spaced elongate retainer members having outstanding, inwardly angled legs, to each side of said end wall adjacent said side edges, (b) providing a generally rectangular flat sheet having side, lower and upper margins and having a width greater than a minimum transverse distance between said inwardly angled legs, (c) attaching an elongate base member to a lower end of the wall, (d) flexing the sheet so that it can be inserted in retained relation between overlapping inwardly angled legs, (e) attaching an upper elongate cap member to an upper end of the wall, and (f) forming the upper and lower members from pan-shaped members having arcuate walls arranged to overlap the lower and upper margins of the sheet whereby the side members and lower and upper members cooperate to form a frame around the sheet.

13. The method of forming a curved end on a merchandiser as defined in claim 12 including an additional step of:

(f) back-lighting a space between the arcuate sheet and the end wall.

14. A merchandiser comprising:

(a) a front wall, a rear wall and opposed generally rectangular flat end walls having. Opposed side edges, (b) frame means carried by each end wall, each frame means including a pair of opposed elongate, generally vertical V-shaped side retaining members formed from two angularly related legs, one of said legs being attached to said end wall adjacent an associated side edge and the other of said legs being angled toward a corresponding leg of the other retaining member, a lower pan-shaped base member having an arcuate front wall portion, a generally straight rear wall portion and a horizontal panel portion connecting said front and rear wall portions, an upper pan-shaped cap member having an arcuate front wall portion, a generally straight rear wall portion and a horizontal panel portion connecting said front and rear wall portions, said cap member being inverted relative to said base member, and attachment means operatively attaching said base member and cap member to associated end walls, (c) an initially flat sheet of translucent material having upper and lower margins and opposed side margins, said side margins being retained in overlapped arcuate configuration by said frame retaining side members, and said lower and upper margins being overlapped by said arcuate wall portions of said base member and cap member respectively, (d) said arcuate sheet and said wall cooperating to define a generally segmental space, and lighting means being provided within the segmental space to back-light the arcuate sheet.

15. A merchandiser as defined in claim 14 in which:

(e) said attachment means for said base member includes fastener means attaching said rear wall portion of said base member to said end wall and said attachment means for said cap member includes a generally horizontal member attached to said end wall and means for attaching said cap member to said horizontal member.

* * * * *